United States Patent [19]

Marklein

[11] 4,018,353

[45] Apr. 19, 1977

[54] VACUUM CLOSURE FOR CONTAINERS

[75] Inventor: Heinz Marklein, Braunschweig, Germany

[73] Assignee: Fa. Schmalbach-Lubeca GmbH, Braunschweig, Germany

[22] Filed: May 7, 1975

[21] Appl. No.: 575,383

[30] Foreign Application Priority Data

May 11, 1974 Germany ..... 7416495[U]
Feb. 5, 1975 Germany ..... 2504803

[52] U.S. Cl. ..... 215/253; 215/274; 215/321; 215/350

[51] Int. Cl.² ..... B65D 41/48

[58] Field of Search ..... 215/253, 274, 277, 317, 215/319, 321, 350, 295, 305; 220/287

[56] References Cited

UNITED STATES PATENTS

| | | | |
|---|---|---|---|
| 2,068,389 | 1/1937 | Smith | 215/350 |
| 2,312,513 | 3/1943 | Wilson | 215/350 X |
| 2,901,140 | 8/1959 | Robinson | 215/277 |
| 2,947,432 | 8/1960 | Marcel | 215/321 |
| 3,656,648 | 4/1972 | Powaloski | 215/253 |

*Primary Examiner*—Donald F. Norton
*Attorney, Agent, or Firm*—Whittemore, Hulbert & Belknap

[57] ABSTRACT

A vacuum closure for a container consisting of a substantially flat and relatively rigid closure member, material for forming a compression-seal disposed around the periphery of the closure member, and a cap-like outer fitment of relatively more flexible material, including a ring-shaped end panel portion extending radially over the outer periphery of the closure member, a skirt portion extending substantially perpendicularly thereto having T-shaped sealing beads in spaced apart circumferential relation on the interior surface thereof, and a lifting ring secured to the ring-shaped end panel for removing the fitment when desired.

12 Claims, 7 Drawing Figures

Fig.2
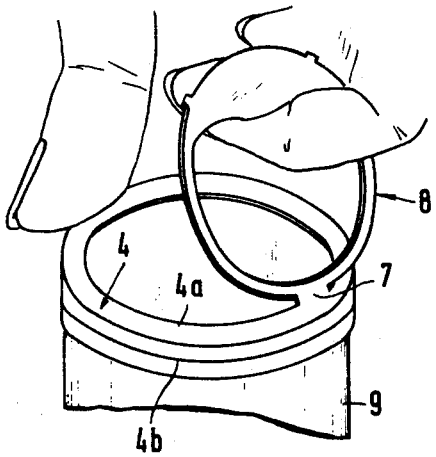
Fig.1
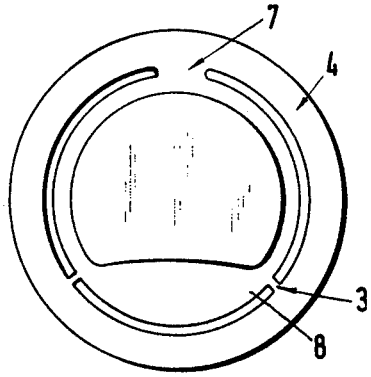
Fig.3
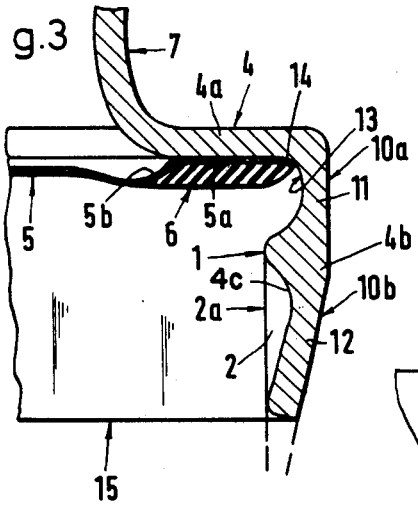
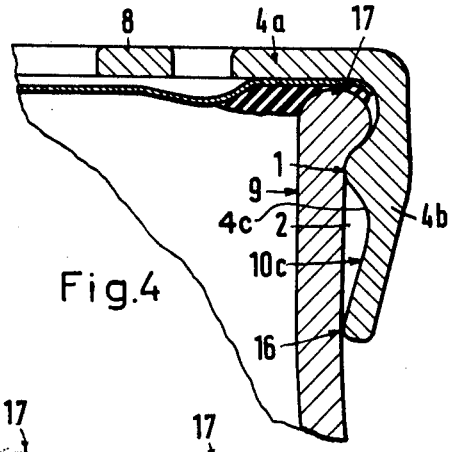
Fig.4
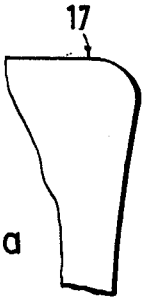
Fig.5a
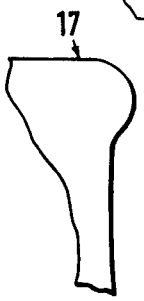
Fig.5b
Fig.6
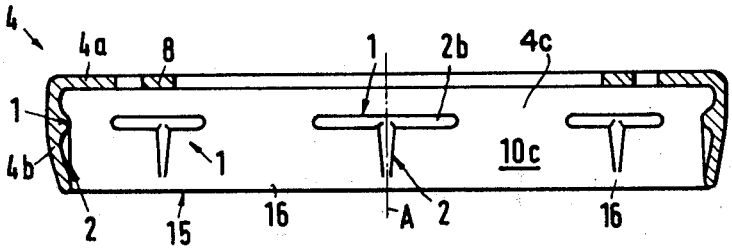

VACUUM CLOSURE FOR CONTAINERS

This invention relates to container packages in general and more specifically it is directed to a composite closure for use on a container to form a package. The present invention relates to a composite closure consisting of an outer flexible plastic fitment and an inner rigid closure panel. This invention may be considered an advance with respect to the composite closure disclosed in U.S. Pat. No. 3,656,648. The rigid closure panel of this invention may be formed from metal and the plastic fitment of this invention provides no convenient point or structure which is readily engageable by a prying tool, for removal thereof. Containers contemplated for use in accordance with this invention include glass, metal, and plastic containers.

The composite closure disclosed in said U.S. patent comprises a collar portion of said fitment which is formed by an outer smooth face and two inner smooth faces extending substantially parallel to said outer face and being connected to each other to form an inner shoulder. This shoulder extends uninterrupted in circumferential direction in an axial distance from a ring-shaped end panel of the fitment for loosely retaining said rigid closure member. The shoulder, furthermore, engages firmly under a shoulder of said container when the closure is in closing position. When the fitment is lifted by means of a lift ring or tab means the shoulder engages the outer edge of the rigid closure panel or closure member for lifting the closure member form the container neck and for breaking the seal between the closure member and the end face of the container.

It has been observed in the course of the utilisation of the composite closure heretofore disclosed in U.S. Pat. No. 3,656,648 that the vacuum closure can only be applied to containers comprising a circumferentially extending bead or shoulder having a remarkable radial extent so that the closure may be fixed on the container neck by the inner shoulder of the fitment engaging under the bead or shoulder of the container.

It is a general object of composite closures improved by the present invention to provide the possibility to apply the closure also to containers comprising no specifically formed neck or radially protruding bead or shoulder.

Hence, it is considered particularly advantageous to provide the art with a composite closure of this type which may be sealingly and securely attached to containers with a smooth outer face, such as blown drinking glasses or cups, glass-containers with fused-on mouth or drinking containers from plastic comprising irregularities of diameter, of geometric shape or of surface finish adjacent the container rim.

It is a further object of this invention to provide a composite closure which, in the closing position, prevents dirt or other contaminations from entering the space between the collar of the fitment and the outer face of the container.

Other objects of this invention will become apparent upon consideration of the following description and the accompanying drawings wherein like reference characters refer to like parts.

In the drawings:

FIG. 1 is a top plan fragmentary view of a glass container package having a composite closure of the present invention assembled to hermetically seal the package.

FIG. 2 is a fragmentary perspective view illustrating the use of the lifting ring for removal of the composite closure from the container improved in accordance with this invention.

FIG. 3 is an enlarged fragmentary cross-sectional view of a composite closure according to this invention after removal from a container package.

FIG. 4 is an enlarged fragmentary cross-sectional elevational view illustrating the relative positioning of members in the closing position of the composite closure.

FIG. 5*a* shows in schematic side elevation of one type of rim portion of a typical container used in connection with the composite closure in accordance with this invention.

FIG. 5*b* shows in schematic side elevation another type of rim portion of a typical container used in connection with the composite closure in accordance with this invention.

FIG. 6 is a vertical cross-sectional view of the fitment of the composite closure in accordance with this invention.

In accordance with this invention a composite closure generally consists of a relatively rigid closure panel 5 and an outer flexible plastic fitment. It may be applied to containers made of glass, plastic, whiteware, metal or to other containers made of other known materials. The closure may be applied with special advantages to containers made of glass, plastic or whiteware. The closure may be used with containers the aperture rim of which is specially formed with a special tool as well as with containers which are produced without specially forming or handling the rim of the container opening with special tools.

An outstanding advantage of the composite closure according to this invention is the fact that this closure may be applied to containers made of glass or plastic which likewise serve as drinking cups or the like and which have no specially shaped container neck, for example, glass containers with melted aperture rims.

The composite closure according to this invention will be described hereinafter in its appliance to containers made of glass, plastic and used as drinking cups.

The composite closure according to this invention comprises two parts that is a closure panel 5 and a ring-shaped outer flexible fitment 4.

The closure panel 5 serves for sealingly closing the container opening. It may have the general configuration of a relatively flat disk or membrane. The closure panel 5 may be a relatively rigid part made from sheet metal, plastic or the like. The panel comprises a ring-shaped periphery portion **5*a* to the inner side of which a sealing material 6 is applied. The outer edge of the closure panel 5 comprises a slight bent 14 extending downwardly. Between this bent 14 and the shoulder 5*b* there may be provided a downwardly opening channel receiving the gasket material 6**.

In a preferred example the fitment consists of a material, especially plastic, more flexible than the material of the rigid closure panel 5. The fitment comprises a ring-shaped end panel generally indicated at **4*a* and a substantially cylindrical skirt portion 4*b*. The fitment comprises in the plane of its end panel a lifting ring 8 or tab means. The end panel and the lifting ring are joined by a band 7 which is an integral hinge. Furthermore, the two parts may be joined by a plurality of readily breakable bridging portions 3. By this means the lifting ring is securely kept in the plane of the end panel 4*a*** before the lifting ring is lifted. In any case the lifting ring may readily be grasped when the container is to be opened. Furthermore, this means provides a tamper proof closure, as far as any person may ascertain at a glance if the bridging portions 3 are broken or not.

The skirt portion 4*b* is integrally connected to the ring-shaped end panel 4 and comprise two sections 11 and 12 following each other in axial direction. The upper section 11 comprises a substantial cylindric outer face 10*a*. The lower section 12 shows a smooth outer face 10*b*, the diameter of which decreases towards the lower edge 15 of the skirt portion.

The skirt portion comprises a substantially smooth inner face. Integrally formed with this face there are several bead means 1 circumferentially arranged in distances from each other. Said means extend radially from the inner face 4*c* of the skirt portion in the direction towards the axis of the closure. The bead means viewed in radial direction are T-shaped. The cross-portions 2*b* of the beads 1 extend in a common plane perpendicular to the axis A of the composite closure. Starting from the stem 2 of the bead 1 the cross portion thereof extends in both circumferential directions. The cross-sectional view of FIG. 3 shows that the cross-portions 2*b* and the inner face of the ring-shaped panel define a recess 13 for loosely retaining the outer edge 14 of the closure panel 5.

The beads 1 are dividing the skirt portion 4*b* in a plurality of sections, following each other in circumferential direction. These sections comprise those parts, which are strengtened by the beads 1 as well as other sections being situated between the beads 1 and, hence, possess a greater flexibility.

The crests 2*a* of the stems 2 and the crests of the cross-parts 2 are substantially positioned on a common cylindric face, the axis of which coincides with Axis A of the closure. The radial thickness of the stem 2 decreases from the cross part 2*b* in the direction towards the rim 15 of the skirt portion. In the preferred example this thickness decreases to zero. The parts are so arranged and constructed that a section 10*c* of the inner face 4*c* of the skirt portion and the crests 2*a* of the stems 2 are coverging in the direction towards the rim 15 of the skirt portion. In the preferred example shown in the drawings the rim 15 of the skirt portion comprises a contacting face 16 extending uninterrupted in circumferential direction adjacent the inner lower edge of the skirt portion. The inner diameter of this contacting face is equal to or smaller than the inner diameter of the crests of the cross portions 2*b* of the beads.

FIG. 6 is a cross-sectional view of the closure before being applied to a container. The closure may be easily pushed on the aperture rim of the container by exerting an axial pressure upon the closure. It is preferred to create a slight or weak vacuum in the head space of the container during the closing procedure. This may be achieved by hot filling the container or by injecting hot steam into the head space just before closing. During the closing procedure the sealing material 6 is sealingly pressed against the end face 17 of the container 9. During this procedure the skirt portion is flexing so that the beads slide over the edge of the container opening into a position at the outer face of the container below the rim in which position they are elastically forced or clamped against said outer face as shown in FIG. 4. In this position the contacting face 16 of the rim of the skirt portion is preferably biased and sealingly pressed against the outer face of the container. The contacting face 16 is at least partly and rigidly connected with the cross portions 2*b* of the beads 1 via the stems 2 of said beads. Due to this rigid connection each connection portion acts as a lever which increases the clamping pressure of the cross parts 2*b* in radial direction against the outer face of the container, surprisingly resulting in an extraordinary and reliable seat of the closure on a container having no special formed neck portion. This also applies to containers of the type shown in the drawings which are in the form of drinking glasses having only a slight rim bead of the shape shown in FIG. 4 and in FIG. 5.

The same result is achieved with containers the rim of which shows a practically cylindrical outer face or a slight negative conicity, as shown in FIG. 5*a*.

The lower portion 12 of the skirt portion is closely pressed against the outer face of the container resulting into a sealing effect adjacent the contacting face 16 and also protecting the closure against unintended loosening during packing, handling, stacking or transporting the closed containers.

The flexibility of the skirt portion ensures that after opening of the container even a child or a housewife is able to press the closure into a sealing position on the container by exerting a slight axial pressure only. For opening the bridge means 3 are broken and the lifting ring 8 is lifted, as shown in FIG. 2. The tension exerted on the lifting ring deforms the skirt portion adjacent the hinge portion so that the cross portions 2*b* of the adjacent beads 1 are able to slide from the clamping position in the direction to the rim of the container. During the sliding movement the cross-portion 2*b* contacting the underside of the bent edge 14 of end panel 5 for lifting the panel from the sealing possition according to FIG. 4 and from the rim of the container. The end panel always remains loosely retained in the fitment.

I claim:

1. Vacuum closure for containers consisting of a substantially flat and relatively rigid closure member having an axis and a cap-like outer fitment of relatively more flexible material, the closure member having means for forming a compression-seal disposed around the periphery thereof by which said closure member is adapted to sealingly engage the end face of the container; said outer fitment including a skirt portion having a smooth outer face adapted to extend downwards, lifting means attached directly to said skirt portion, said skirt portion having a lower edge and including inwardly directed bead means for engaging the outer face of the container when the closure is in closing position and engaging under the outer edge of said closure member when said fitment is lifted by means of the lifting means, wherein the inwardly directed bead means consist of a plurality of beads circumferentially spaced apart from each other each of which being T-shaped including a stem and cross portion when viewed in radial direction and arranged in such a manner that the stem of the said T-shaped bead extends substantially parallel to the axis of the closure member and towards the lower edge of said collar portion.

2. Vacuum closure according to claim 1 wherein the radial extent of the stem of each T-shaped bead decreases from the cross portion towards the lower edge of said collar portion.

3. Vacuum closure according to claim 1, wherein the cross portion of each T-shaped bead extends substantially circumferentially and is in axial spaced relation to a ring-shaped end panel of said fitment for loosely retaining said rigid closure member.

4. Vacuum closure according to claim 1, wherein the inner face of said collar portion comprises a circumferentially uninterrupted bandlike contacting portion adjacent the lower edge of said collar portion having an inner diameter not greater than the inner diameter of the crests of the circumferentially extending portions of said T-shaped bead, the contacting portion adapted to contact the outer face of a container when the closure is in closing position.

5. A press-on pull-off closure cap for containers consisting of a substantially flat and relatively rigid closure member and a cap-like outer fitment of relatively more flexible material, said closure member having means for forming a compression-seal disposed around the periphery thereof by which said closure member is adapted to sealingly engage the end of the container; said outer fitment including a skirt portion having a smooth outer face adapted to extend downwards toward a container body, wherein said skirt portion comprises a plurality of bead means of T-shaped outline each having a stem portion and a circumferentially extending cross portion circumferentially spaced apart on the inner face of said skirt portion is such a manner that the stem portion of each T-shaped bead and the smooth outer face of said skirt portion coverage in the direction from the circumferentially extending cross-portion of the T-shaped bead towards the lower edge of said skirt portion.

6. A press-on pull-off closure cap according to claim 5 wherein the stem portion of each T-shaped bead includes a crest and the crest of the stem portion of each T-shaped bead extends substantially parallel to the axis of the closure cap.

7. A press-on pull-off closure cap according to claim 5, wherein the cross-portion of each T-shaped bead includes a crest which crests have an inner diameter and the inner face of said skirt portion comprises a circumferentially uninterrupted band-like contacting portion adjacent the lower edge of said collar portion having an inner diameter not greater than the inner diameter of the crests of the cross portions of said T-shaped beads, the contacting portion adapted to contact the outer face of a container when the closure is in closing position and is connected to the cross portions via the stems of said beads.

8. A press-on pull-off closure cap according to claim 5 wherein the cross-portions of the beads, in the closing position of the closure cap, are adapted to be securely and elastically pressed in radial direction against the outer surface of the end of a container.

9. A vacuum closure for containers consisting of a substantially flat and relatively rigid closure member and a cap-like fitment of relatively more flexible material, the closure member having means for forming a compression seal disposed around the periphery thereof, by which said closure member is adapted to sealingly engage the end face of the container; said outer fitment including a skirt portion having a smooth outer face adapted to extend downwards, wherein said skirt portion has an inner face and includes a plurality of bead means of T-shaped outline including stem and cross portions circumferentially spaced apart on the inner face of said skirt portion, the cross-portion of which bead means extending substantially in circumferential direction and in axial spaced relation from a ring-shaped end panel of sad fitment for loosely retaining said rigid closure member.

10. Vacuum closure according to claim 9, wherein the stem portions of the T-shaped bead means each includes a crest and the crest of the stem portion of each T-shaped bead means extends substantially parallel to the axis of the closure cap.

11. A vacuum closure according to claim 9, wherein the radial extent of each T-shaped bead means decreases from the cross-portion of each bead means towards the lower edge of said skirt portion.

12. A vacuum closure according to claim 9, wherein the cross portions of the T-shaped beads include crests and the inner face of said skirt portion comprises a circumferentially uninterrupted band-like contacting portion adjacent the lower edge of said skirt portion having an inner diameter not greater than the inner diameter of the crests of the cross portions of said T-shaped beads, the contacting portion adapted to contact the outer face of a container when the closure is in closing position and is connected to the cross-portions via the stems of said beads.

* * * * *